United States Patent [19]

Kagler, Jr.

[11] Patent Number: 4,550,781

[45] Date of Patent: Nov. 5, 1985

[54] METHOD OF AND APPARATUS FOR CUTTING AND RECOVERING OF SUBMARINE SURFACE CASING

[75] Inventor: Edmond Kagler, Jr., Sugar Land, Tex.

[73] Assignee: A-Z International Tool Company, Houston, Tex.

[21] Appl. No.: 617,746

[22] Filed: Jun. 6, 1984

[51] Int. Cl.[4] ..... E21B 29/00

[52] U.S. Cl. ..... 166/340; 166/365; 166/55.7

[58] Field of Search ..... 166/340, 338, 361, 362, 166/365, 297, 55.3, 55.6–55.8

[56] References Cited

U.S. PATENT DOCUMENTS

| | | | |
|---|---|---|---|
| 667,194 | 2/1901 | Curtin | 166/55.7 |
| 2,203,011 | 6/1940 | Ellis et al. | 166/55.7 |
| 3,983,936 | 10/1976 | Kennard et al. | 166/365 X |
| 4,047,568 | 9/1977 | Aulenbacher | 166/55.8 X |

*Primary Examiner*—Stephen J. Novosad

*Assistant Examiner*—Thut M. Bui

*Attorney, Agent, or Firm*—Vinson & Elkins

[57] ABSTRACT

A method of cutting and retrieving submarine well casing which includes the steps of lowering a tool on a string into the bore of the well casing which tool includes a casing cutter, a bumper sub connecting from the cutter to the combined anchor swivel and latching means to retain the anchor in unset position when it is being run with the string connected to the upper end of the tool, landing the tool with the swivel supported on the upper end of the casing and the remainder of the tool within the casing, releasing the latching means, raising the string to set the anchor, tensioning the string, energizing the cutter arms, rotating the string to cut the casing, and raising the string to retrieve the cut casing. The apparatus includes a casing cutter, a bumper sub, a combined anchor swivel and latching means to retain the anchor in unset position which latching means is actuated to unlatched position by manipulation of the string on which the tool is supported.

12 Claims, 7 Drawing Figures

METHOD OF AND APPARATUS FOR CUTTING AND RECOVERING OF SUBMARINE SURFACE CASING

BACKGROUND

The present invention relates to an improved method and apparatus for use in cutting submarine casing and retrieving such casing and the other equipment on the ocean floor. One particular reason for this operation is the removal of equipment which might create a hazard if it were to remain in place on the ocean floor.

U.S. Pat. No. 3,983,936 discloses one method which cuts and recovers such submarine wellhead equipment. It involves the steps of lowering a string including a casing cutter, a spear and a swivel and landing the swivel on the upper end of the casing. The cutting is commenced and when complete the spear is expanded to firmly engage within the casing to allow it to be raised as the string is recovered.

Another patent disclosing, a modified form of such method, is U.S. Pat. No. 4,191,255. It differs from the U.S. Pat. No. 3,983,936 in that it maintains the spear above the upper end of the casing during cutting and then when cutting is complete, is lowered into the cut casing and set so that the submarine wellhead equipment may be raised with the string and thereby recovered from the ocean floor.

SUMMARY

The prior methods for the recovering of submarine wellhead equipment and the upper end of the casing have been successful but ease of operation as possible can be improved and the engagement of the casing should be provided as early in the operation so that tension can be exerted on the casing during the cutting operation. This continuous tension ensures that there can be no slippage of the casing either during or after cutting and also the engagement of the casing is completed before cutting rather than requiring manipulations of the string after cutting.

An object of the present invention is to provide an improved method and apparatus for cutting and retrieving submarine casing in a single trip with greater economy of operation.

Another object is to provide an improved submarine casing cutting and retrieving method which has improved efficiency of operation.

A further object is to provide improved submarine casing cutting and retrieving apparatus which is simpler and has greater reliability.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
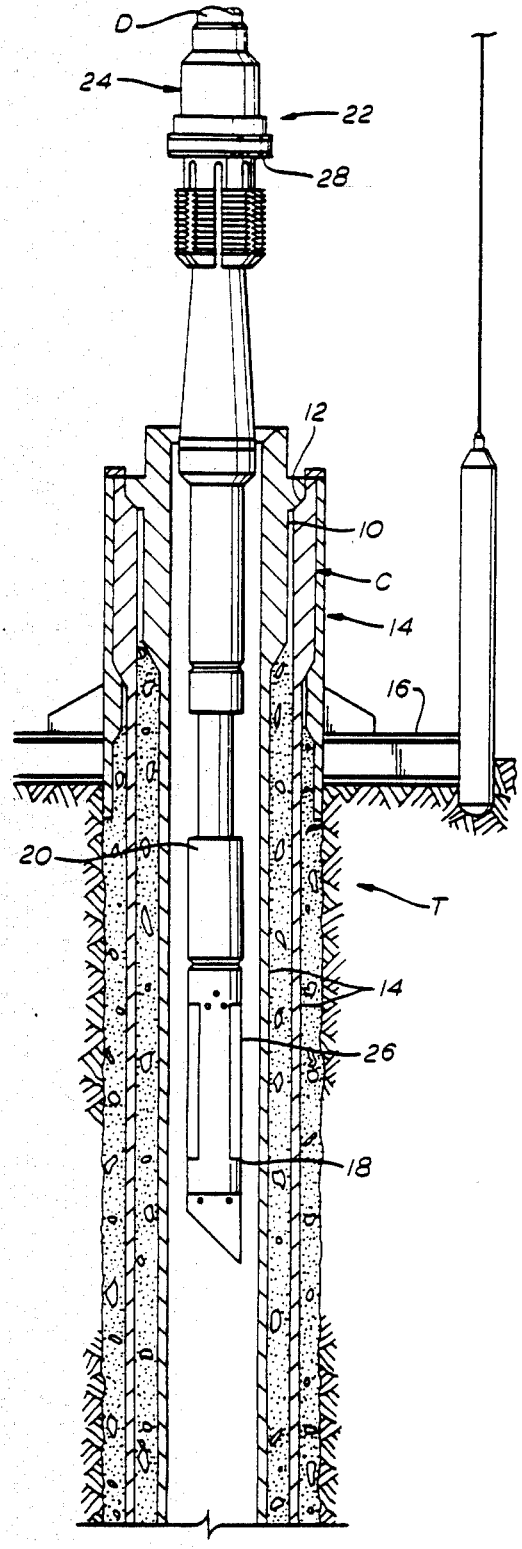
FIG. 1 is a sectional view of a submarine well with the improved apparatus being run into the submarine casing.

The improved apparatus of the present invention is lowered on drill string D into the open end of the submarine wellhead W within the casing C as best seen in FIG. 1. Inner casing 10 has seat 12 on its upper end and is within one or more outer casing strings 14 which are surrounded by guide base 16. Drill string D is connected to the improved combined tool T of the present invention.

Tool T includes casing cutter 18 on its lower end and connected to bumper sub 20 with combined anchor swivel 22 thereabove and being connected to drill string D. Suitable latching means 24 is provided to retain the anchor portion of anchor swivel 22 in its unset position as the tool T is being run. This latching means 24 is also capable of unlatching by manipulation of the drill string D to allow the anchor to be set within inner casing 10 prior to the beginning of the cutting step.

Figure 2:
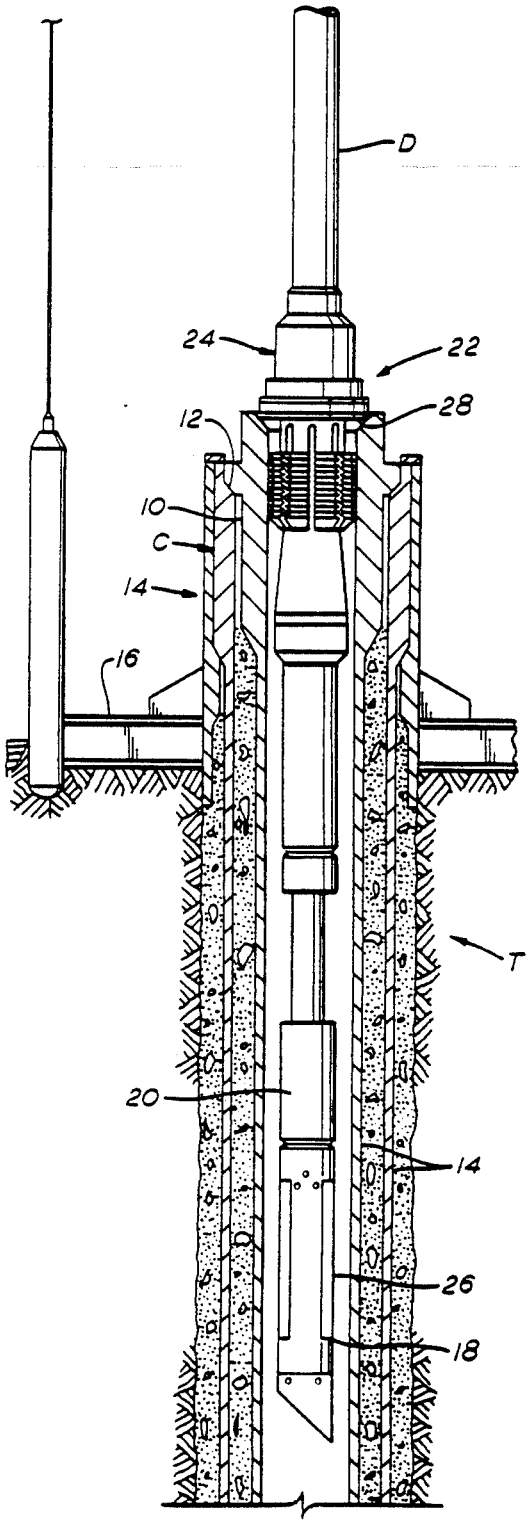
FIG. 2 is another view similar to FIG. 1 with the string landed on the upper end of the submarine casing.
Figure 3:
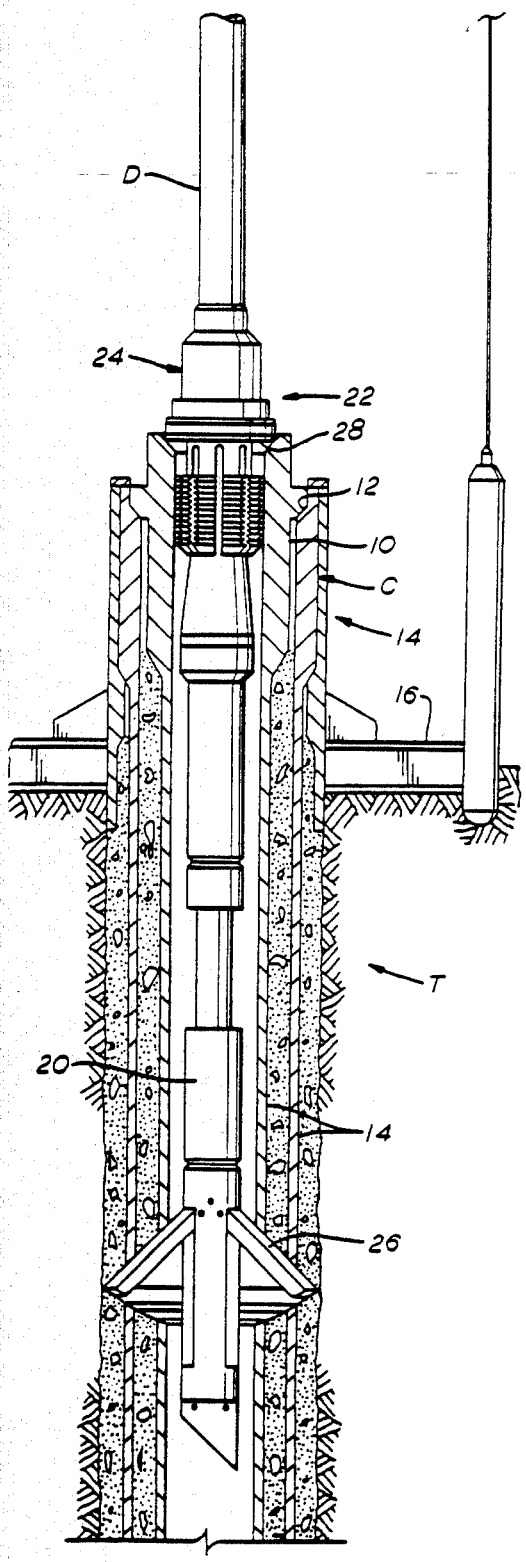
FIG. 3 is another similar view showing the cutting step of the present invention.
Figure 4:
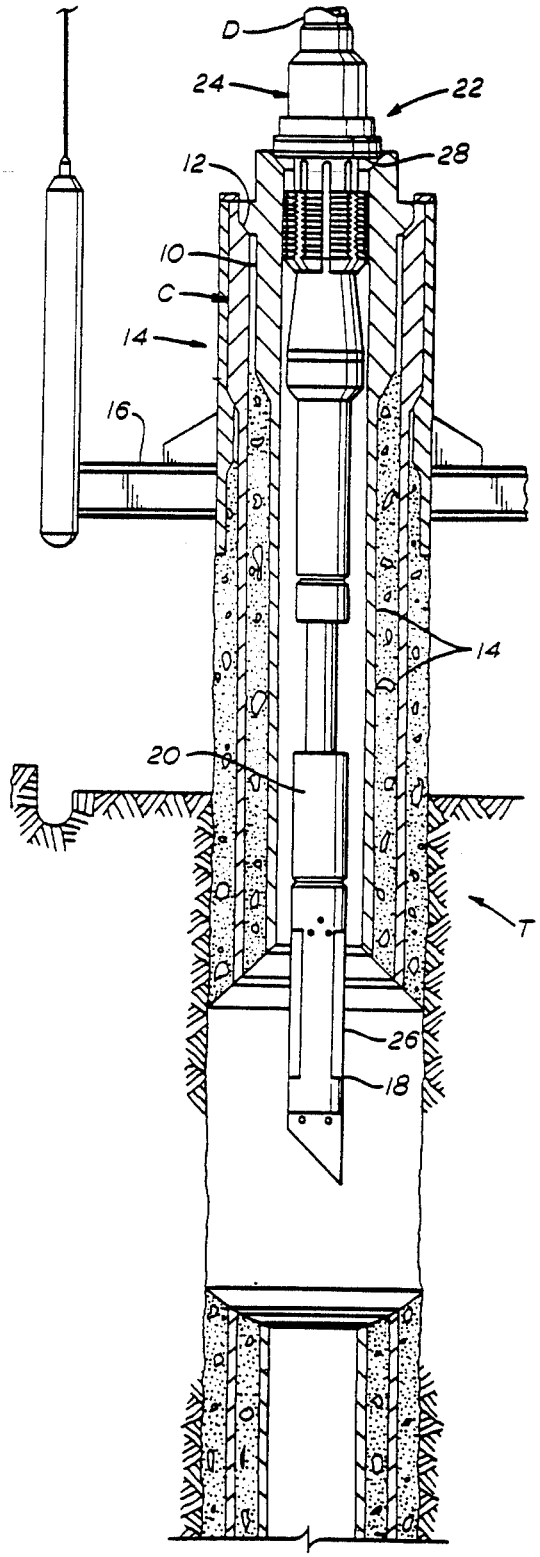
FIG. 4 is another similar view showing the retrieving step of the present invention.

Casing cutter 18 may by any suitable type such as that shown in the prior U.S. Pat. No. 3,983,936 which is actuated by pressure fluid delivered through drill string D to cause cutter arms 26 to be urger outwardly and cutting proceeds by rotation of drill string D while cutter arms are urges outward. This cutting step is illustrated in FIG. 3 which follows the landing of shoulder 28 on seat 12, the releasing of latch means 24 and the setting of anchor of anchor swivel 22 which is the position shown in FIG. 2. During cutting drill string D is held in tension so that the casing C is held under tension and when cutting is complete the tension allows the retrieval of the cut casing C and guide base 16 as shown in FIG. 4.

Figures 5, 6:
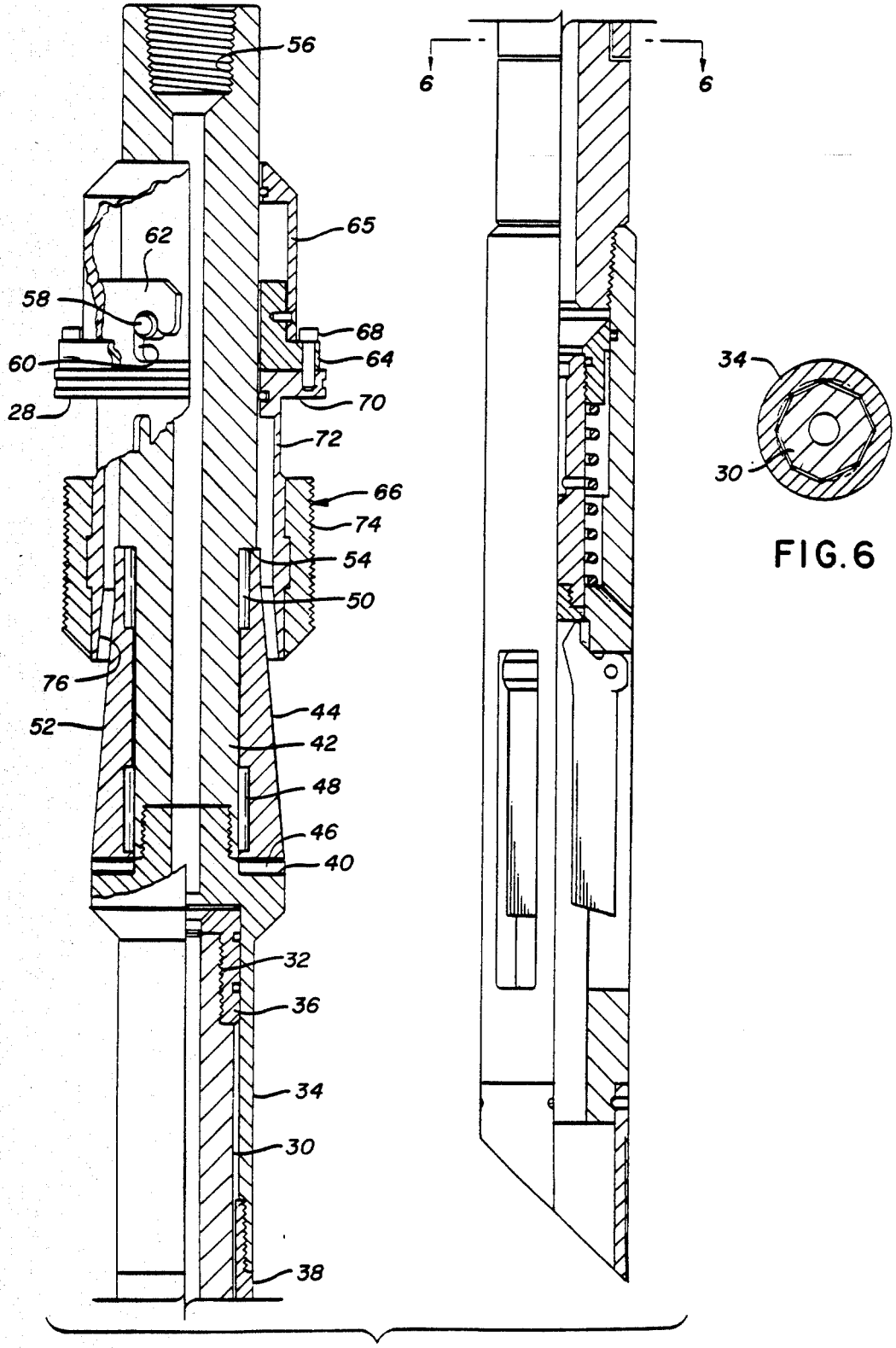
FIG. 5 is a view, partly in section, of the improved apparatus of the present invention.
FIG. 6 is a section view taken along line 6—6 in FIG. 5.
Figure 7:
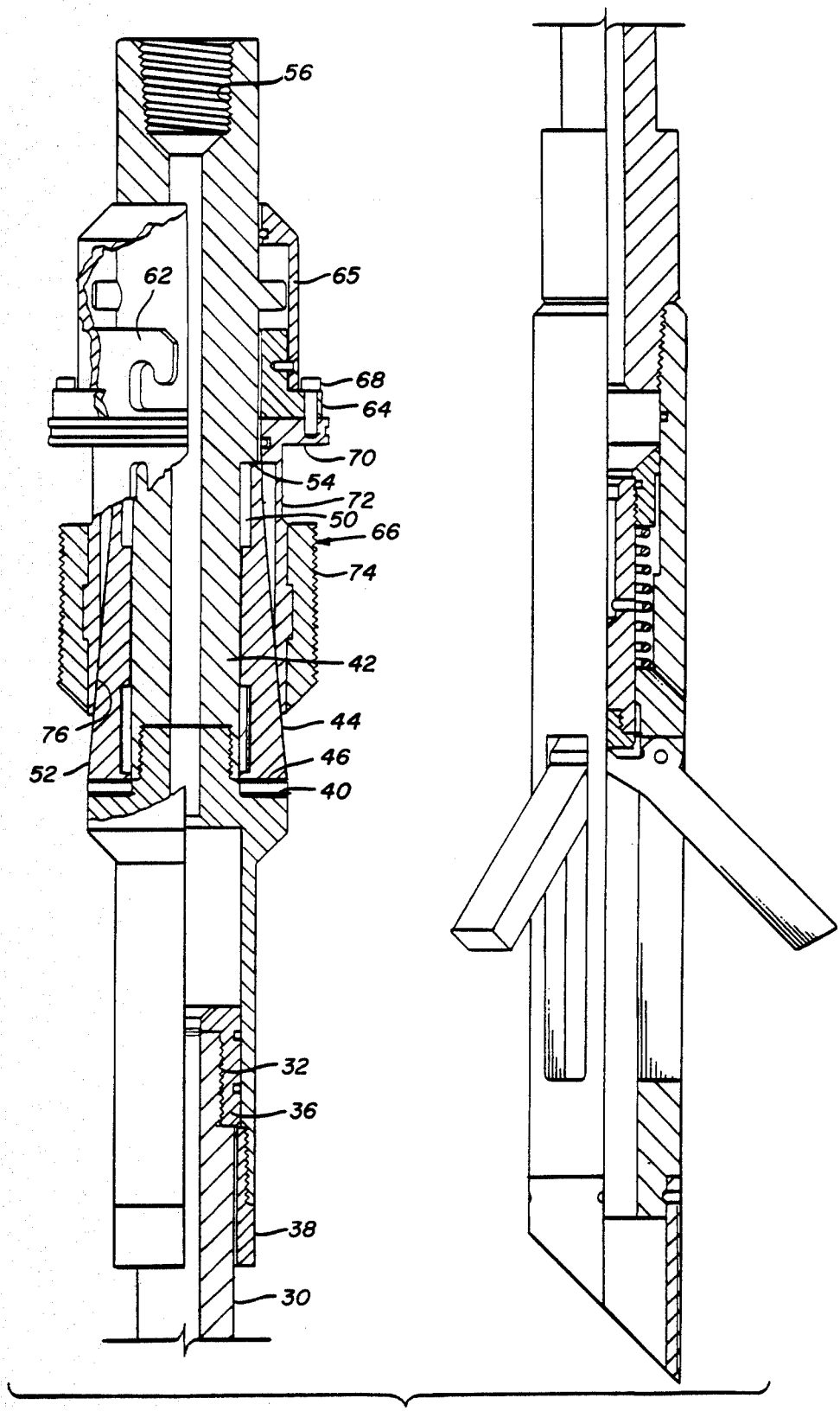
FIG. 7 is another sectional view of the improved apparatus of the present invention with the bumper sub in extended position.

The details of tool T are shown in FIGS. 5, 6, and 7. Bumper sub 20 includes hollow mandrel 30 having pin end 32 on its lower end for threaded connection into casing cutter 18 and sleeve 34. The exterior of mandrel 30 is hex shaped mating with the interior of sleeve 34 as best seen in FIG. 6. This allows rotation of drill string D to be transmitted to casing cutter 18 and allows relative axial movement between mandrel 30 and sleeve 34. This allows the anchor portion of anchor swivel 22 to be unset if drill string D needs to be recovered independent of or prior to the completion of the cutting of casing C. Ring 36 is threaded onto the upper end of mandrel 30 and has a slightly larger exterior than the hex shaped portion. Ring 38 is threaded into the lower end of sleeve 34 and has a slightly smaller interior than the hex portion of sleeve 34. The engagement of rings 36 and 38 prevent disengagement of mandrel 30 and sleeve 34.

The upper end of sleeve 34 is upset to form upwardly facing shoulder 40 and is threaded to receive upper mandrel 42 which is threaded onto the lower end of drill string D. Cone ring 44 surrounds upper mandrel 42 and is provided with support on its lower end bearing ring 46 and on its interior by bearing rings 48 and 50 which are positioned at the upper and lower interior of cone ring 44. The exterior of cone ring 44 includes wedge surface 52 which tapers upwardly and inwardly. The upper end of cone ring 44 is immediately under downwardly facing shoulder 54 of upper mandrel 42. The upper end of mandrel 42 includes threaded box end 56 for receiving the pin end of drill string D. Pins 58 are secured to the exterior of upper mandrel 42 and coact with J slot 60 in collar 62. Collar 62 includes flange 64 to which anchoring elements are secured by cap screws 68. A cover or cap 65 secured to collar 62 extends upwardly thereover, and then inwardly adjacent upper mandrel 44 to form a cover over collar 62 for protecting the pin and J slot connection as shown in FIGS. 5 and 6. Anchoring elements 66 include upper ring 70 and flexible arms 72 on the exterior of which are mounted slips 74. The lower interior of arms 72 are tapered upwardly and inwardly on surface 76 to receive wedge surface 52 of cone ring 44. Upper ring 70 extends outwardly to mate with flange 64 and also provides downwardly facing shoulder 28 which engages seat 12 when tool T has been landed on wellhead W. Thus, latching means 24 is provided by the engagement of pins 58 in J slots in collar 62. The latched position shown in FIG. 5 prevents the raising of cone ring 44 with respect to anchoring elements 66. When unlatched, collar 62 and anchoring elements 66 are not moved by upward movement of drill string D thus allowing cone ring 44 to be raised within surfaces 76 to cause slips 74 to be wedged into tight gripping engagement with the interior of inner casing 10. This engagement is sufficient to allow the continuous exertion of a tension on drill string D during cutting and to support the cut casing C and guide base 16 on drill string D during retrieval.

The relative movement of bumper sub 20 allows drill string D to be lowered at any time to allow cone ring 44 to be removed from under anchoring elements 66 and thus unset the engagement of slips 74 with the interior of inner casing 10. At the same time, pins 58 can be rotated into the latched position of J slots 60 and tool T can be recovered separately from the cut casing or prior to the completion of the cutting of the casing.

What is claimed is:

1. An apparatus for cutting and retrieving a submarine casing comprising:

a lower casing cutter having cutting arms which can be urged outwardly to cut submarine casing while the cutter is rotated;

an integral anchor and swivel combination above the casing cutter mounted for movement between an anchored engaged position with the casing to restrain longitudinal movement relative to the casing, and a disengaged position to permit movement thereof relative to the casing, said integral anchor and swivel combination having a central bore therethrough and gripping elements for engaging the casing in a gripping relation;

a mandrel suspended from a drill string extending through said central bore in said anchor and swivel combination and mounted for rotation relative to said combination, said mandrel connected in drive relation to said casing cutter for rotating said cutter in cutting relation to said casing;

latching means between said mandrel and said anchor and swivel combination selectively movable between a latched position in which said mandrel and said anchor and swivel combination rotate together, and an unlatched position in which said mandrel rotates relative to said anchor and swivel combination and is permitted to move longitudinally relative to said combination; and actuating means for said gripping elements mounted on said mandrel for longitudinal movement therewith and for relative rotational movement, said actuating means upon movement of said latching means to an unlatched position and raising of the mandrel moving said gripping elements into gripping relation with said casing and placing said mandrel and drill string in tension, and upon subsequent lowering of said mandrel and drill string releasing said gripping elements from gripping relation with said casing, said mandrel being mounted for rotation relative to said gripping elements and said actuating means in both the raised and lowered positions thereof.

2. An apparatus for cutting and retrieving a submarine casing as set forth in claim 1 wherein said latching means comprises a pin and J slot connection between said mandrel and said integral anchor and swivel combination.

3. An apparatus for cutting and retrieving a submarine casing as set forth in claim 2 wherein said integral anchor and swivel combination has a cap extending over said pin and J slot connection for protection thereof.

4. An apparatus for cutting and retrieving a submarine casing as set forth in claim 1 wherein said actuating means for said gripping elements comprises a tapered ring mounted on said mandrel below said gripping elements for urging said gripping elements outwardly into engagement with said casing in the raised position of the mandrel thereby to set the gripping elements.

5. An apparatus for cutting and retrieving a submarine casing comprising:

a lower casing cutter having cutting arms which can be urged outwardly to cut submarine casing while the cutter is rotated;

anchor means above the casing cutter seated on the casing and mounted for movement between an anchored engaged position with the casing to restrain longitudinal movement relative to the casing, and a disengaged position to permit movement of the anchor means relative to the casing, said anchor means having a central bore therethrough and gripping elements for engaging the casing in a gripping relation;

a mandrel having an upper portion secured to a drill string extending through said central bore in said anchor means and mounted for rotation relative to said anchor means, said mandrel having a lower portion connected in drive relation to said casing cutter for rotating said cutter in cutting relation to said casing;

latching means between said upper mandrel portion and said anchor means selectively movable between a latched position in which said upper mandrel portion and said anchor means rotate together, and an unlatched position in which said upper mandrel portion rotates relative to said anchor means and is permitted to move longitudinally relative to said anchor means; and actuating means for said gripping elements mounted on said upper mandrel portion for longitudinal movement therewith and for relative rotational movement, said actuating means upon movement of said latching means to an unlatched position and raising of the mandrel moving said gripping elements into gripping relation with said casing and placing said mandrel and drill string in tension, and upon subsequent lowering of said mandrel and drill string releasing said gripping elements from gripping relation with said casing, said mandrel being mounted for rotation relative to said gripping elements and said actuating means in both the raised and lowered positions thereof.

6. An apparatus for cutting and retrieving a submarine casing as set forth in claim 5 wherein means mount said lower portion of the mandrel connected to said cutter for longitudinal movement relative to said upper portion of the mandrel upon unlatching of said latching means whereby the upper portion of said mandrel may be raised relative to the lower portion of said mandrel and relative to said cutter upon setting of said gripping elements to exert tension on said drill string during cutting of the casing.

7. An apparatus for cutting and retrieving a submarine casing as set forth in claim 6 wherein said means to mount said lower portion of the mandrel comprises a bumper sub secured to said cutter, said upper portion of the mandrel having a lower sleeve receiving the upper end portion of said bumper sub for longitudinal movement between an extended position and a retracted position whereby upon completion of the cutting operation said upper portion of said mandrel and said actuating means for said gripping elements may be lowered relative to the lower portion of said mandrel and said cutter to unset said gripping elements from said casing.

8. An apparatus for cutting and retrieving a submarine casing comprising:

a lower casing cutter having cutting arms which can be urged outwardly to cut submarine casing while the cutter is rotated;

anchor means above the casing cutter seated on the casing and mounted for movement between an anchored engaged position with the casing to restrain longitudinal movement relative to the casing, and a disengaged position to permit movement of the anchor means relative to the casing, said anchor means having a central bore therethrough and gripping elements for engaging the casing in a gripping relation;

a mandrel having an upper portion secured to a drill string extending through said central bore in said anchor means and mounted for rotation relative to said anchor means, and mandrel having a lower portion connected in drive relation to said casing cutter for rotating said cutter in cutting relation to said casing;

latching means between said upper mandrel portion and said anchor means selectively movable between a latched position in which said upper mandrel portion and said anchor means rotate together, and an unlatched position in which said upper mandrel portion rotates relative to said anchor means and is permitted to move longitudinally relative to said anchor means; and actuating means for said gripping elements mounted on said upper mandrel portion for longitudinal movement therewith and for relative rotational movement, said actuating means upon unlatching of said latching means movable longitudinally with said mandrel to a raised position relative to said anchor means to move said gripping elements outwardly into gripping relation with said casing to set said gripping elements, said upper portion of said mandrel having an open ended sleeve on its lower end receiving the upper end of the lower portion of said mandrel for relative longitudinal movement, said sleeve and said lower portion of said mandrel having a rotational drive connection therebetween permitting relative longitudinal movement.

9. An apparatus for cutting and retrieving a submarine casing as set forth in claim 8 wherein said actuating means for said gripping elements comprises a tapered ring mounted on said mandrel below said gripping elements for urging said gripping elements outwardly into engagement with said casing in the raised position of the mandrel thereby to set the gripping elements.

10. A method of cutting and recovering submarine well casing including the steps of:

lowering into the open end of a submarine well casing a drill string having a mandrel with a casing cutter, an anchor and swivel combination, and releasable latching means between said combination and mandrel, the anchor and swivel combination having a seat and anchor elements thereon;

landing the drill string within the submarine well casing with the anchor and swivel combination seated on the upper end of the submarine casing which is to be cut;

manipulating the drill string to release the latching means whereby the mandrel may be moved longitudinally relative to the anchor and swivel combination and the upper end of the casing;

raising the mandrel after release of the latching means for contacting and setting said anchor elements against the casing while exerting a tension on said mandrel and the drill string, the anchor and swivel combination remaining in seated position on the upper end of the submarine casing during raising of the mandrel;

energizing said cutter for movement of cutter arms thereon into cutting contact with the casing;

rotating said drill string and the mandrel to cut the casing;

lowering of said mandrel and drill string for release of the anchor elements from gripping engagement with the casing and release of the tension from said mandrel while said anchor and swivel combination remains in seated position on said casing; and retrieving the cut casing by raising said drill string.

11. The method of cutting and recovery of cutting and recovery of submarine casing as set forth in claim 10 further including the step of providing a lost motion connection between the cutter and an upper portion of the mandrel whereby the mandrel may move longitudinally relative to the cutter upon the upward movement of the mandrel to set the anchor elements thereby to exert a tension stress on the drill string during the cutting operation upon unlatching of the latch means and setting of the anchor elements without any upward movement of the cutter.

12. The method of cutting and recovering submarine well casing as set forth in claim 11 further including the step of relatching said mandrel and anchor and swivel combination after lowering of the mandrel relative to said combination and release of the anchor elements from said casing, the lowering of the mandrel being accomplished relative to the cutter through the lost motion connection between the upper portion of the mandrel and the lower portion of the mandrel, thereby to permit latching of the mandrel and further cutting of casing prior to retrieving the cut casing.

* * * * *